US005360289A

United States Patent [19]

Takada et al.

[11] Patent Number: 5,360,289

[45] Date of Patent: Nov. 1, 1994

[54] DRAINAGE WATER PUMPING STATION AND METHOD FOR OPERATING THE SAME

[75] Inventors: Kunio Takada, Iwawa; Kenji Otani, Tsuchiura; Sadashi Tanaka, Chiyoda, all of Japan

[73] Assignee: Hitachi, Ltd., Tokyo, Japan

[21] Appl. No.: 900,418

[22] Filed: Jun. 18, 1992

[30] Foreign Application Priority Data

Jun. 20, 1991 [JP] Japan ..... 3-148557

[51] Int. Cl.[5] ..... E03F 1/00

[52] U.S. Cl. ..... 405/52; 137/567; 405/36; 405/80

[58] Field of Search ..... 405/36, 37, 52; 137/567; 417/2, 3,

[56] References Cited

U.S. PATENT DOCUMENTS 4,013,087 3/1977 Hanna ..... 137/567 X
4,892,440 1/1990 Regan ..... 405/36

FOREIGN PATENT DOCUMENTS 1051124 3/1957 Germany ..... 137/567

OTHER PUBLICATIONS

Ehara Jihou No. 109 (1979), pp. 13–16 Large Municipal Sewage Pumps By Hiroyoshi Yamamoto.

*Primary Examiner*—Dennis L. Taylor
*Attorney, Agent, or Firm*—Antonelli, Terry, Stout & Kraus

[57] ABSTRACT

A plurality of drainage pumps are disposed on a high floor gradation state in a circular arrangement. A plurality of drainage pumps are disposed on a low floor gradation state in a circular arrangement. The drainage pumps disposed on the high floor gradation are installed at a high level, with the drainage pumps having a low pump head and a large capacity in comparison with the drainage pumps disposed at the low floor gradation. An outer shape of an underground pump construction building is in the form of a circular cone shape spreading toward an upper portion of the underground pump construction building. The amount of power for discharging the drainage can be reduced and the construction area for the underground pump construction building can be reduced thereby minimizing the necessary requirement for installation of the underground pump construction.

12 Claims, 4 Drawing Sheets

DRAINAGE WATER PUMPING STATION AND METHOD FOR OPERATING THE SAME

DESCRIPTION OF THE INVENTION

1. Field of the Invention

The present invention relates to a drainage water pumping station and a method for operating the same, and particularly relates to a drainage water pumping station and a method for operating the same in the city and the outskirts of the city.

The drainage water pumping station in the present invention employs a construction for a drainage water system in which an inflow water main pipe line and a pump construction building are buried deeply under the ground.

2. Prior Art

At present, in the city so as to meet the problems about the flood caused by the rainfall and the inundation of the rivers etc., a drainage water system has been installed. This drainage water system is constructed such that a drainage water pumping station is provided on the down stream side of an inflow water main pipe line and has plural drainage pumps.

From a discharge water passage including the small rivers of the city and the outskirts of the city, the rainwater etc. are gathered into the inflow water main pipe line of the drainage water pumping station. Such a gathered inflow water is led into the drainage water pumping station and is discharged by means of the drainage pumps toward the rivers, the lakes and marshes or the sea as a discharge water flow destination.

Besides, in general, in correspondence with the fluctuation of the inflow water amount, the discharge water amount is adjusted in accordance with the operation of the drainage pumps in the drainage water pumping station. A plurality of the drainage pumps are prepared in response to the necessary discharge water amount. By controlling the running number of the drainage pumps the control or the adjustment for the discharge water amount is carried out in the drainage water pumping station.

Further, when an operator of the drainage water pumping station attends to control finely the discharge water amount, in general it is carried out by combining a vane angle control of the drainage pump and a speed control of the drainage pump. By the reason of the difficulty for obtaining of the required area of land or the required area of site etc. for the equipment of the drainage water pumping station, the following drainage water system construction is currently employed in the city.

The conventional drainage water system is constructed such that the inflow water main pipe line is buried under the ground, namely the so-called underground river system is employed. Further, so as to fit the above inflow water main pipe line construction the drainage water pumping station itself is also buried under the ground.

A conventional underground drainage water pumping station is described in, for example, the document (Ehara Jihou No. 109, 1979, pages 13–16). According to this document, the following underground drainage water system in the city is mentioned.

The underground drainage water system shown in the above document comprises mainly an inflow water main pipe line which is disposed on the discharge water subject district, two pump wells and plural drainage pumps surrounding the two pump wells. The plural drainage pumps are arranged in a circular shape surrounding the two pump wells.

In this underground drainage water system, two pump wells relating to two independent drainage water systems are provided independently with the same drainage water pumping station, and further surrounding such two pump wells are the plural drainage pumps relating to the respective drainage water systems and arranged in a semi-circular shape. These drainage pumps are arranged horizontally on only one flat plane or only a single stage in the circular shape. Further, a pump construction building in this drainage water system is formed to have a circular shape from an upper end to a lower end thereof and is arranged outside of the two pump wells.

With the construction of the underground drainage water system stated above, by means of the inflow water main pipe line the inflow water is led into the pump wells of the drainage water pumping station. The control of the discharge water amount is accomplished by control of the running number and the speed of the drainage pumps.

In the above stated underground drainage water system, in response to the enlargement of the subject discharge water district and the increase in the inflow water amount and further so as to make fully the installation route of the inflow water main pipe line and the dynamic water gradient, there is a tendency to provide the underground drainage water system at great depth in which both the inflow water main pipe line and the pump construction building are buried deeply under the ground.

However, when an underground drainage water system of great depth is employed, the necessary pump head for the drainage pumps becomes high in response to the buried installation depth of the inflow water main pipe line.

In the above stated prior art, it is necessary to operate all of the drainage pumps at the whole range from the minimum water level to the maximum water level of the pump well. As a result, problems occur about the rises in the power cost for discharging the discharge water from the drainage pumps and about the equipment cost of installing the pump construction building due to the necessity of the higher pump head for the drainage pump.

Further, the more the necessary number of the drainage pumps increases, the more the construction area (the projection area) for the pump installation construction building is enlarged. Accordingly the working amount including the underground digging working increases. Further, there occurs the problem of construction cost etc. for constructing the pump construction building. In particular, there occurs the problem of increased engineering working cost for digging working at the great depth underground.

DISCLOSURE OF INVENTION

An object of the present invention is to provide a drainage water pumping station wherein the power for running the drainage pumps can be reduced.

Another object of the present invention is to provide a drainage water pumping station wherein the construction area for constructing the pump construction building can be reduced.

A further object of the present invention is to provide a drainage water pumping station wherein the construction working amount such as a digging working under the great depth underground can be lessened.

A further object of the present invention is to provide a method for operating a drainage water pumping station wherein the power cost for discharging the discharge water from the drainage pumps can be reduced.

In accordance with the present invention, a drainage water pumping station comprises a pump well into which rainwater etc. can flow through an inflow water main pipe line which is buried under the ground and a plurality of drainage pumps for discharging the inflow water in the pump well into a discharge water flow destination such as a river.

The plural drainage pumps are installed at a floor gradation state having at least two floors with a different installation level.

It is desirable to set each rating of each drainage pump from a high pump head to a low pump head and from a small capacity to a large capacity in order in proportion to a low floor gradation state to a high floor gradation state.

It is desirable to have a construction in which drainage pumps in the same stage floor gradation state are disposed in a circular shape, a congregated delivery pipe line is installed lengthwise at a center of the circular shape of the drainage pumps, and a delivery pipe line from each drainage pump is connected to the congregated delivery pipe line.

Further, it is desirable to have a construction in which a ring-like congregated suction sump is installed concentrically with the circular shape state of the drainage pumps in communication with the pump well and a suction tube of each the drainage pump is connected to the congregated suction sump.

In accordance with the present invention, at least an outer shape of a low portion of the underground pump construction building in which the drainage pumps are installed is formed with a circular cone shape spreading toward an upper portion. The outer shape of the underground pump construction building of the drainage pumping station can be made to have the circular cone shape state spreading toward the upper portion at lower portion and to have a circular column shape at an upper portion.

In accordance with the present invention, in the above stated drainage water pumping station construction, the drainage pumps are operated in order starting from the low floor gradation state to the high floor gradation state in proportion to a rise of the water level of the pump well.

With the above stated drainage water pumping station construction and the operating method for the drainage water pumping station, the following operations can be attained according to the present invention.

At first, in the case of the underground drainage water pumping station, in general since the buried level of the inflow water main pipe line is low, the difference between the low water level and the high water level of the pump well relating to the running range of the drainage pumps becomes large.

Accordingly, when the plural drainage pumps are installed at the several levels of the floor gradation state, since the difference between the water level of the discharge water flow destination such as river and further the plural drainage pumps disposed on the high floor gradation state become small, the necessary pump head becomes small enough thereby reducing the power for discharging the discharge water.

In particular, in the drainage water system when the water level of the pump well is low it can need the discharge water amount, can be small and the discharge water amount from the drainage water pumping station can be increased in proportion to the rise of the water level of the pump well.

Accordingly, as the ratings for each of the drainage pumps, it is desirable that the higher the plural drainage pumps are installed lower the floor gradation state the lower the pump head and the larger the capacity of the pumps.

Since the drainage pumps having the low pump head and the large capacity have a high pump efficiency over a the wide range, the reduction effect in a discharge water power can be attained remarkably.

Further, since the plural drainage pumps are installed at the floor gradation state having at least two floors, the necessary construction area for the underground pump construction building can be made small.

Accordingly, the working amount including the underground digging working in the pump construction building can be reduced, and the increase in the construction cost can be restrained. In particular, in the case that the plural drainage pumps in the same stage are arranged in a circular shape the above stated effects can be attained remarkably.

Further, when the water level of the pump well is low it is unnecessary to speedily discharge the water, so that the plural drainage pumps disposed on the low floor gradation state having a high pump head can have a small capacity.

Accordingly, the installation construction area of each floor gradation state of the underground pump construction building can be progressively smaller in proportion to going to the low gradation state, and at least the outer shape of the low portion of the underground pump construction building can be formed as a circular cone state spreading toward the upper portion, whereby the digging amount at the deep underground portion can be reduced, and construction costs lowered to a remarkable extent.

BEST MODE FOR CARRYING OUT THE INVENTION

Figure 1:
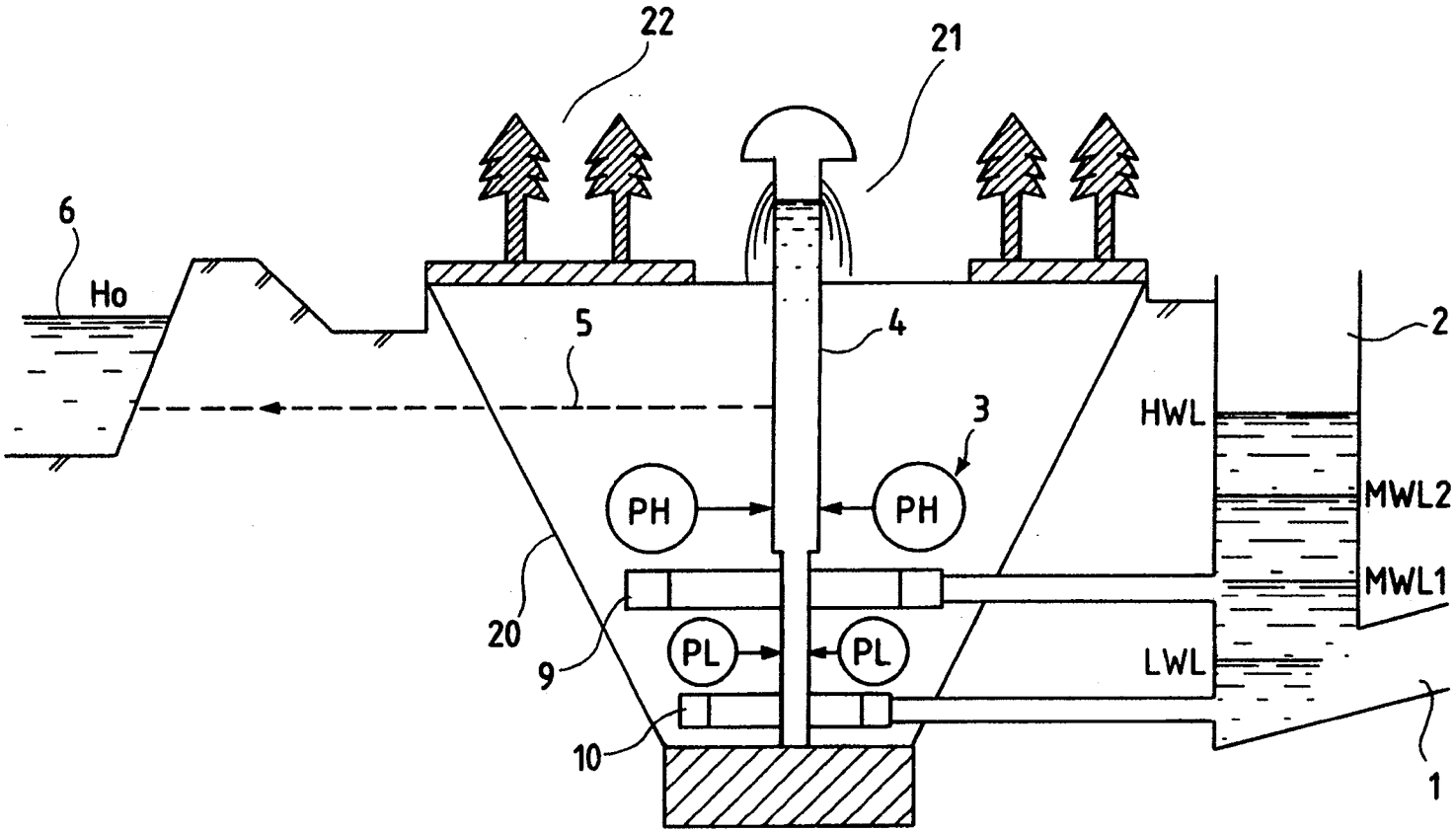
FIG. 1 is a longitudinal sectional schematic construction view showing one embodiment of a drainage water pumping station according to the present invention.

Hereinafter, one embodiment of a drainage water pumping station and a method for operating the drainage water pumping station according to the present invention will be explained referring to the drawings.

Referring now to the drawings, in the drainage water pumping system in FIG. 1 inflow water such as rainwater is gathered by an inflow water main pipe line 1 which is installed in the discharge water subject district. The inflow water flows into a pump well 2. The inflow water in the pump well 2 is pumped up by a group of plural drainage pumps 3 and discharged into a discharge water flow destination such as river 6 through a congregated delivery pipe line 4 and a drainage water passage 5.

The drainage pump group 3 in this embodiment is constructed with a first stage drainage pump group PH and a second stage drainage pump group PL. The first stage drainage pump group PH and the second stage drainage pump group PL are arranged in a floor gradation two floors with a different installation level.

More specifically, the pumps of the first stage drainage pump group PH have a low pump head and a large capacity, and those of the second stage drainage pump group PL have a high pump head and a small capacity. The first stage drainage pump group PH is disposed on the high floor gradation state (the upper floor gradation state) and the second stage drainage pump PL is disposed on the low floor gradation state. The first stage drainage pump group PH comprises drainage pumps PH1, PH2, . . . , and PHn (n: a natural number) installed in the drainage water pumping station. Also, the second stage drainage pump group PL comprises drainage pumps PL1, PL2, . . . , and PLn (n: a natural number) installed in the drainage water pumping station.

In this embodiment of the present invention, the first stage drainage pump group PH comprises four drainage pumps and also the second stage drainage pump group PL comprises four drainage pumps. However, it is preferable to as the first stage drainage pump group PH from a minimum of about three drainage pumps to seven drainage pumps. Further, it is preferable to install as the second stage drainage pump group PL from a minimum of about three drainage pumps to seven drainage pumps.

In this embodiment of the present invention, a two stage discharging pump group in the drainage water pumping station is exemplified. However, the discharging pump group could include three stages or four stages etc., installed in the drainage water pumping station.

Figure 3:
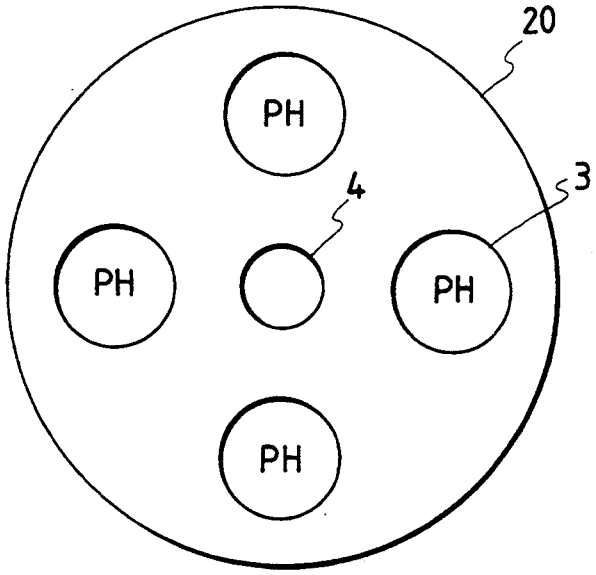
FIG. 3 is a schematic construction view showing a first stage drainage pump group disposed on a high floor gradation state.
Figure 4:
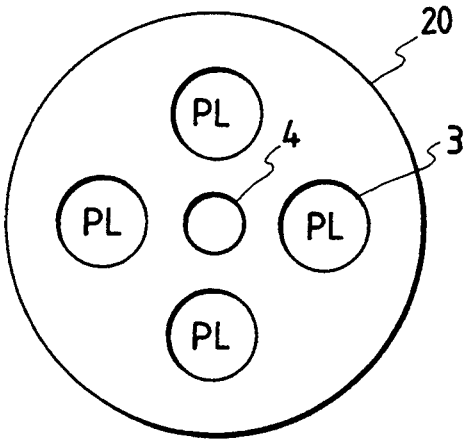
FIG. 4 is a schematic construction view showing a second stage drainage pump group disposed on a low floor gradation state.

Each drainage pump of the first stage drainage pump group PH is installed respectively at a floor gradation state with a circular shape with the pumps of the group being arranged symmetrically and at equal intervals in the circle, as shown in FIG. 3. Each drainage pump of the second stage drainage pump group PL is also installed respectively at a floor gradation state with a circular shape wherein the pumps are arranged symmetrically and at equal intervals, as shown in FIG. 4.

A suction tube 7 of the first stage drainage pump group PH is communicated with the pump well 2 through a ring-like congregated suction sump 9. A suction tube 8 of the second stage drainage pump group PL is communicated with the pump well 2 through a ring-like congregated suction sump 10.

Each of the congregated suction sumps 9 and 10 is formed respectively in a circular shape for cooperation with the circularly arranged drainage pumps of its associated stage drainage pump group PH and PL. The suction tube 7 of the first stage drainage pump group PH is provided with a suction sluice valve 11. The suction tube 8 of the second stage drainage pump group PL is also provided with a suction sluice valve 12.

The congregated delivery pipe line 4 has a longitudinal shape around the drainage pump group 3 and connects to each of a delivery pipe line 13 of the first stage drainage pump group PH and a delivery pipe line 14 of the second stage drainage pump group PL.

An upper portion of the congregated delivery pipe line 4 is communicated with the river 6 through the discharge water passage 5. A pipe diameter of the congregated delivery pipe line 4 is formed to get thinner toward the low floor gradation state in accordance with discharge water amount of each floor gradation state.

An underground pump construction building 20 installs the above drainage pump group 3 and is arranged at a side portion of the pump well 2. An outer shape of an underground pump construction building 20 is formed with a circular cone shape spreading toward the upper portion as shown in FIG. 1.

A reason for employing the above stated construction is so that the installation area of the second stage drainage pump group PL, which has the high pump head and the small capacity and is installed at the floor gradation of the lower state, is small in comparison with that of the first stage drainage pump group PH, which has the low pump head and the large capacity and is installed at the upper floor gradation state.

An electric motor 15 is provided on each drainage pump of the first stage drainage pump group PH and an electric motor 16 is provided on each drainage pump of the second stage drainage pump group PL, respectively.

Figure 2:
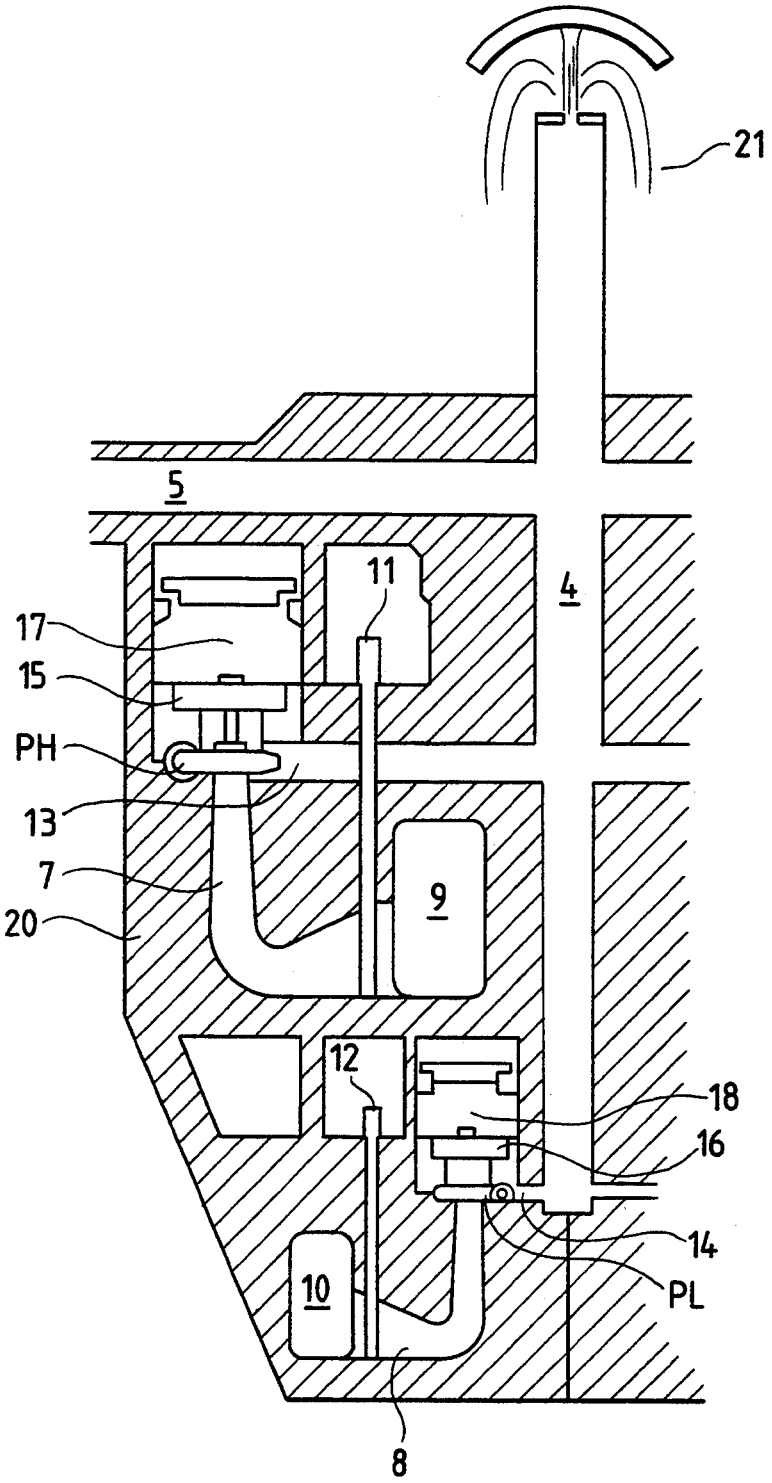
FIG. 2 is a detailed sectional view showing a section of a drainage pump arrangement of the drainage water pumping station shown in the embodiment of FIG. 1.

Further, as shown in FIG. 2, the underground pump construction building 20 can be formed to have the circular cone shape state spreading toward the upper portion at the lower portion and to have a circular column shape state at the upper portion. The outer shape of the underground pump construction building shown in FIG. 2 is modified with respect to the outer shape of the underground pump construction building shown in FIG. 1. This underground pump construction building 20 provides maintenance areas 17 and 18 for maintaining the first stage and the second stage drainage pump group PH and PL and the motors 15 and 16.

As shown in FIG. 2, an upper end of the congregated delivery pipe line 4 is formed to expose or project over the ground. At the exposed portion of the congregated delivery pipe line 4, for example, it can provide the jet of water or the waterfall 21. Further, it can utilize the upper ground portion of the underground pump construction building 20 as the park 22 etc., as shown in FIG. 1.

The difference in level between the water level Ho of the river 6 as the discharge water flow destination and the installation level of the first stage drainage pump group PH is smaller than the difference in level between the water level Ho of the river 6 and the installation level of the second stage drainage pump group PL.

With the above drainage water pumping station construction, according to the embodiment of the present invention, as to the first stage drainage pump group PH disposed on the high floor gradation state, the facts will be explained as follow.

Namely, the difference in level between the water level Ho of the river 6 and the installation level of the first stage drainage pump group PH is smaller than that between the water level Ho and the installation level of the second stage drainage pump group PL. Therefore, the necessary pump head of the first stage drainage pump group PH can be smaller and the discharge water power reduced.

In particular and before, for the rating of the first stage drainage pump group PH disposed on the high floor gradation state the pumps can have a low pump head and a large capacity. Such pumps have a high pump efficiency covering a wide range. Therefore, a remarkable reduction effect in the discharge water power can be attained.

Further, in the drainage water system, in a case that the water level of the pump well 2 is low, the discharge water amount may be small and as the water level rises in the pump well 2, the discharge water amount can be made to increase in proportion to the rise of the water level.

For example, as shown in FIG. 1, at an intermediate portion between the low water level LWL (for example, water level: −60 m) of the pump well 2 and the low water level HWL (for example, water level: −15 m) of the pump well 2, an intermediate water level MWL1 (for example, water level: −45 m) and an intermediate water level MWL2 (for example, water level: −30 m) for controlling a running number in the drainage pump are set, respectively.

In accordance with the rise in the water level the pumps of the first stage drainage pump group PH disposed on the high floor gradation state are operated one after another, thereby the discharge water power can be reduced effectively.

Further, since the first stage and the second stage drainage pump groups PH and PL are installed at the floor gradation state having at least two floors, the necessary construction area for the underground pump construction building 20 can be made small. As a result, the working amount including the underground digging working can be reduced and also the increase in the construction cost for the underground pump construction building 20 can be restrained.

In particular, since each of the first stage and the second stage drainage pump groups PH and PL is arranged respectively in the circular shape, the outer shape of the underground pump construction building 20 can be formed in a circular cone shape as shown in FIG. 1. As a result the construction cost for constructing the underground pump construction building 20 can be remarkably reduced.

Further, when the water level of the pump well 2 is low, then it is unnecessary to speedily discharge the water so that the pumps of the second stage drainage pump group PL disposed on the low floor gradation state which have a high pump head may have a small capacity.

Accordingly, the construction area for each floor gradation state of the underground construction building 20 is gradually reduced in compliance with going to the low floor gradation state. When at least the outer shape of the low portion of the underground pump construction building 20 is made in the form of a circular cone spreading toward the upper portion, since the digging amount at the deep underground portion can be reduced, therefore the the construction cost of the underground pump construction building 20 can be remarkably reduced.

Herein, one example of the reduction effect in the discharge water power according to the embodiment of the present invention will be explained referring to FIG. 5.

Figure 5:
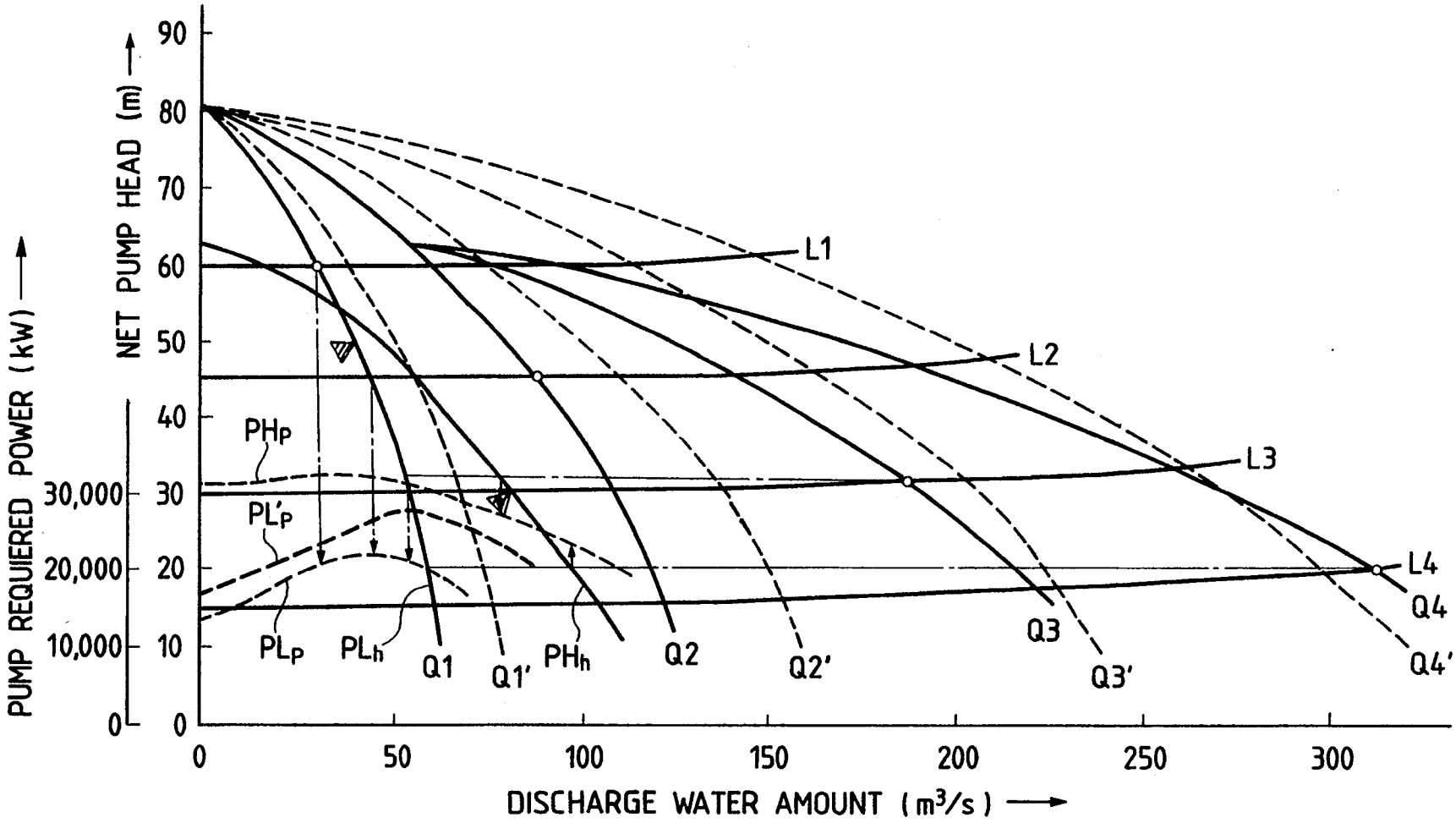
FIG. 5 is a chart for explaining the effects according to the embodiment shown in FIG. 1 and showing a characteristic curve line Q between a discharge water amount ($m^3/s$) and a total pump head (m) of a parallel running number the drainage pump group, a characteristic curve line P between a discharge water amount ($m^3/s$) and a pump required (kW) per single drainage pump, and a loss curve line L of the individually parallel running number of the drainage pump.

FIG. 5 shows a characteristic curve line Q of a discharge water amount ($m^3/s$) and a total pump head (m) of a parallel running number of pumps of the drainage pump group, a characteristic curve line P of a discharge water amount ($m^3/s$) and a pump required power (kW) per single drainage pump, and a loss curve line L of the individual pumps of the drainage pump group, respectively.

The installation number and the rating of the pumps of the first stage and the second stage drainage pump groups PH and PL according to one example of the present invention and the installation number and the rating of the pumps of the drainage pump group PL' according to a comparative example are shown in Table 1.

In this comparative example, all of the drainage pumps of the drainage pump group PL' have the same rating, further these drainage pumps of the drainage pump group PL' are installed at the low floor gradation of the above embodiment of the present invention, namely similar to the second stage drainage pump group PL.

TABLE 1

| | |
|---|---|
| (Example of the Present Invention) | |
| Drainage pump PH disposed on high gradation floor | |
| number | 2 |
| rate pump head | 30 m |
| rate capacity | 82 $m^3/s$ |
| rate pump required power | 35 MW |
| Drainage pump PL disposed on low gradation floor | |
| number | 2 |
| rate pump head | 50 m |
| rate capacity | 40 $m^3/s$ |
| rate pump required power | 25 MW |
| (Comparative Example) | |
| Drainage pump PH disposed on high gradation floor | |
| number | 4 |
| rate pump head | 50 m |
| rate capacity | 50 $m^3/s$ |
| rate pump required power | 30 MW |

Further, in FIG. 5, the real lines show the drainage pumps of the embodiment according to the present invention and the broken lines show the drainage pumps according to the comparative example, and an affixed number attached to the reference code of each curve line indicates the number of parallel running drainage pumps.

Each of the characteristic curve lines Q1, Q2, Q3 and Q4 shows the discharge water amount and the total pump head under one number running pump condition, two number running pump condition, three number running pump condition and four number running pump condition, according to the present invention. Each of the characteristic curve line Q1', Q2', Q3' and Q4' shows the discharge water amount and the total pump head under one number running pump condition, two number running pump condition, three number running pump condition and four number running pump condition, according to the prior art.

A characteristic curve line $PH_h$ shows the pump net head of the first stage drainage pump group PH according to the present invention. A characteristic curve line $PL_h$ shows the pump net head of the first stage drainage pump group PL according to the present invention.

A characteristic curve line PHp shows the discharge water amount and the pump required power of the first stage drainage pump group PH according to the present invention. A characteristic curve line PLp shows the discharge water amount and the pump required power of the second stage drainage pump group PL according to the present invention. A characteristic curve line PL'p shows the discharge water amount and pump required power of the drainage pump group according to the prior art.

Each of the characteristic curves L1, L2, L3 and L4 shows the loss curve line under one number running pump condition, two number running pump condition, three number running pump condition and four number running pump condition according to the present invention.

In FIG. 5 and the above stated conditions, the running number of the drainage pumps was controlled in accordance with the change in the water level of the pump well 2. As a result, in a case that the time in one number running, two number running, three number running and four number running in the drainage pumps is one hour, respectively, and the necessary discharge water power for the drainage pumps requested can be obtained the as shown in Table 2.

TABLE 2

| (Example of the Present Invention) |
|---|
| Required discharge water power (MWH) |
| 1 number × 20 MWH |
| 2 number × 21.5 MWH |
| 2 number × 20.7 MWH + 1 number × 27 MWH |
| 2 number × 20 MWH + 2 number × 23 MWH |
| Total 217.4 MWH |
| (Comparative Example) |
| Required discahrge water power (MWH) |
| 1 number × 25 MWH |
| 2 number × 27 MWH |
| 3 number × 26 MWH |
| 4 number × 25 MWH |
| Total 257 MWH |

As shown from the above calculation results, the necessary discharge water power in the embodiment according to the present invention can be reduced to about 85% in comparison with the prior art shown in the comparative example.

The above results are caused mainly by the following conditions. Since the first stage drainage pump group PH having the low pump head and the large capacity has the high pump efficiency covering the wide range of the discharge water amount, the first stage and the second stage drainage pump groups PH and PL are installed at respective floor gradation states at different installation levels as shown in this embodiment according to the present invention.

Further the rating of the first stage drainage pump group PH disposed on the high floor gradation state is set to have the low pump head and the large capacity in comparison with the second stage drainage pump group PL disposed on the low floor gradation state.

As explained above, according to the embodiment of the present invention the following various remarkable effects can be obtained.

Each of the first stage and the second stage drainage pump groups PH and PL is installed respectively at a different floor gradation state. The first stage drainage pump group PH disposed on the high gradation state is located with a small difference in the installation level with respect to the water level Ho of the river 6 as the discharge water flow destination in comparison with that of the second stage drainage pump group PL.

Accordingly, the necessary pump head in the first stage drainage pump group PH becomes small enough at such a high part, that the discharge water power in the first stage drainage pump group PH can be reduced.

In particular, with respect to the rating of the first stage drainage pump group PH disposed on the high floor gradation state, when the ratings of the low pump head and the large capacity for the first stage drainage pump group PH are employed, since pumps with such a low pump head and large capacity have a high pump efficiency over a wide range, the reduction effect in the discharge water power in the first stage drainage pump group PH can be attained remarkably.

Further, since the first stage and the second stage drainage pump group PH and PL are installed at the upper and lower gradation states, the necessary construction area of the underground pump construction building 20 can be made small.

As a result, the working amount including the underground digging working necessary for construction can be reduced and further the increase in the construction cost for the underground pump construction building 20 can be restrained. In particular, when the first and second stage drainage pump groups PH and PL are arranged in the circular shape, the above stated reduction effects can be attained remarkably.

When the water level of the pump well 2 is low, it is unnecessary to speedily discharge the water so that the pumps of the second stage drainage pump group PL disposed on the low floor gradation state having the high pump head can have a small capacity.

Accordingly, the construction area at the lower floor gradation state of the underground pump construction building 20 can be made smaller in proportion to that of the upper floor gradation state. When at least the outer shape of the low portion of the underground pump construction building 20 is formed to have the circular cone state spreading toward the upper portion, the digging amount at the deep underground portion can be reduced. Therefore, the reduction effect in the construction cost for constructing the underground pump construction building 20 can be attained remarkably.

Further, with an increase in the water level of the pump well 2, the operation of the first stage and the second stage drainage pump group PH and PL can start with the pump group at the low floor gradation state (the second stage drainage pump group PL) and, with a further increase in water level, proceed to the pump group at the high floor gradation state (the first stage drainage pump group PH) in order. Therefore, since unnecessary operation of the low pump head drainage pumps of the pump group PH can be avoided, the discharge water consumed by the pumps of the pumping station power can be reduced effectively.

We claim:

1. A drainage water pumping station comprising:

a pump well into which drainage water can flow through an underground inflow main pipe line, and a plurality of drainage pumps for discharging said drainage water in said pump well into a discharge destination, wherein said plurality of drainage pumps are installed at a floor gradation state having at least two floors at a different installation level, said plurality of drainage pumps have a first stage drainage pump group comprising a high pump head and a small capacity and a second drainage pump group having a low pump head and a large capacity, said first stage drainage pump group having the high pump head and the small capacities installed at a lower floor of said floor gradation state, and said second stage drainage pump group having the low pump head and the large capacities installed at a higher floor of said floor gradation state.

2. A drainage water pumping station comprising:

a pump well into which drainage water can flow through an underground inflow main pipe line, and a plurality of drainage pumps having a low pump head and a large capacity for discharging said drainage water in said pump well into a discharge destination, wherein a first stage drainage pump group comprising a plurality of drainage pumps is installed at a high floor gradation state, a second state drainage pump group comprising a plurality of drainage pumps is installed at a low floor gradation state, said plurality of drainage pumps of said second stage drainage pump group have a high pump head and a low capacity, said plurality of drainage pumps of said first stage drainage pump group and said plurality of drainage pumps of said second stage drainage pump group are disposed respectively in a circular arrangement.

3. A drainage water pumping station comprising:

a pump well into which drainage water can flow through an underground inflow main pipe line, and a plurality of drainage pumps for discharging said drainage water in said pump well into a discharge destination, wherein said plurality of drainage pumps are installed at a floor gradation state having at least two floors with a different installation level, and wherein a rating of each of said drainage pumps is set from a high pump head to a low pump head and from a small capacity to a large capacity in proportion to the installation level of the pump from a low floor gradation state to a high floor gradation state.

4. A drainage water pumping station comprising:

a pump well into which drainage water can flow through an underground inflow water main pipe line, and a plurality of drainage pumps for discharging said drainage water in said pump well into a discharge destination, wherein a first stage drainage pump group comprises a plurality of drainage pumps installed at a high floor gradation state, a second stage drainage pump group comprises a plurality of drainage pumps installed at a low floor gradation state, said drainage pumps of said first stage drainage pump group and said drainage pumps of said second stage drainage pump group are disposed respectively in a circular arrangement, and wherein said drainage pumps of said first stage drainage pump group have a higher pump head than said drainage pumps of said second stage drainage pump group and said drainage pumps of said first stage drainage pump group have a smaller capacity than said drainage pumps of said second stage drainage pump group.

5. A drainage water pumping station, comprising:

a pump well into which drainage water can flow through an underground inflow main pipe line, and a plurality of drainage pumps for discharging said drainage water in said pump well into a discharge destination, wherein a first stage drainage pump group comprising a plurality of drainage pumps is installed at a high floor gradation state, a second stage drainage pump group comprising a plurality of drainage pumps is installed at a low floor gradation state, said plurality of drainage pumps of said first stage drainage pump group and said plurality of drainage pumps of said second stage drainage pump group are disposed respectively in a circular arrangement, wherein a congregated delivery pipe line is installed lengthwise at a center of said circular arrangement of said drainage pumps, and a delivery pipe line from each drainage pump is connected to said congregated delivery pipe line.

6. A drainage water pumping station according to claim 5, wherein a ring-like congregated suction sump is installed concentrically with the circular arrangement of said drainage pumps in communication with said pump well, and a suction tube of each drainage pump is connected to said congregated suction sump.

7. A drainage water pumping station comprising:

a pump well into which drainage water can flow through an underground inflow water main pipe line, a plurality of drainage pumps for discharging said drainage water in said pump well into a discharge destination, and an underground pump construction building in which said drainage pumps are installed, wherein said drainage pumps are installed at a floor gradation state having at least two floors with a different installation level, and wherein at least an outer shape of a lower portion of said underground pump construction building is formed with a circular cone shape spreading toward an upper portion of the pump construction building.

8. A drainage water pumping station comprising:

a pump well into which drainage water can flow through an underground inflow water main pipe line, a plurality of drainage pumps for discharging said drainage water in said pump well into a discharge destination, and an underground pump construction building in which said drainage pumps are installed, wherein said drainage pumps are installed at a floor gradation state having at least two floors with a different installation level, a rating of each of said drainage pumps is set from a high pump head to a low pump head and from a small capacity to a large capacity in proportion to the installation level of the pump from a low floor gradation state to a high floor gradation state, the drainage pumps of each floor gradation are disposed in a circular arrangement, a congregated delivery pipe line is installed lengthwise at a center of said circular arrangement of said drainage pumps, a delivery pipe line from each of said drainage pumps is connected to said congregated delivery pipe line, a ring-like congregated suction sump is installed concentrically with the circular arrangement of said drainage pumps in communication with said pump well, and a suction tube of each drainage pump is connected to said congregated delivery pipe line, and wherein at least an outer shape of a lower portion of said underground pump construction building is formed with a circular cone shape spreading toward an upper portion of said underground pump construction building.

9. A drainage water pumping station comprising:

a pump well into which drainage water can flow through an underground inflow main pipe line, a plurality of drainage pumps for discharging said drainage water in said pump well into a discharge destination, an underground pump construction building in which said drainage pumps are installed, wherein a first stage drainage pump group comprising a plurality of drainage pumps is installed at a high floor gradation state, a second stage drainage pump group comprising a plurality of drainage pumps is installed at a low floor gradation state, said drainage pumps of said first stage drainage pump group and said second stage drainage pump group are disposed respectively in a circular arrangement, a rating of each of said drainage pumps is set from a high pump head to a low pump head and from a small capacity to a large capacity in proportion to the installation level of the pump from a low floor gradation state to a high floor gradation state, a congregated delivery pipe line installed lengthwise at a center of said circular arrangement of said drainage pumps, a delivery pipe line from each of said drainage pumps is connected to said congregated delivery pipe line, a ring-like congregated suction sump is installed concentrically with the circular arrangement of said drainage pumps in communication with said pump well, a suction tube of each drainage pump is connected to said congregated delivery pipe line, and wherein at least an outer shape of a lower portion of said underground pump construction building is formed with a circular cone shape spreading toward an upper portion of said underground pump construction building.

10. A method for operating a drainage water pumping station including:

a pump well into which drainage water can flow through an underground inflow water main pipe line, a plurality of drainage pumps for discharging said drainage water in said pump well into a discharge destination such as a river, wherein said drainage pumps are installed at a floor gradation state having at least two floors with a different installation level, and wherein a rating of each of said drainage pumps is set from a high pump head to a low pump head and from a small capacity to a large capacity in proportion to the installation level of the pump from a low floor gradation state to a high floor gradation state, said method comprising:

beginning an operation of each of said drainage pumps in order from said low floor gradation state to said high floor gradation state in proportion to a rise in a water level of said pump well.

11. A drainage water pumping station comprising:

a pump well into which drainage water can flow through an underground inflow water main pipeline, and a plurality of drainage pumps for discharging said drainage water in said pump well into a discharge destination, wherein a first stage drainage pump group comprises a plurality of drainage pumps installed at a high floor gradation state, a second stage drainage pump group comprises a plurality of drainage pumps installed at a low floor gradation state, said drainage pumps of said first stage drainage pump group and said drainage pumps of said second stage drainage pump group are disposed respectively in a circular arrangement, wherein said drainage pumps of said first stage drainage pump group have a higher pump head then said drainage pumps of said second state drainage pump group and said drainage pumps of said first stage drainage pump group have a smaller capacity then said drainage pumps of said second stage drainage pump group, a congregated delivery pipe is installed lengthwise at a center of said circular arrangement of said drainage pumps, and wherein a delivery pipe line from each drainage pump is connected to said congregated delivery pipe line.

12. A drainage water pumping station according to claim 11, wherein a ring-like congregated suction sump is installed concentrically with the circular arrangement of said drainage pump in communication with said pump well, and a suction tube of each drainage pump is connected to said congregated suction sump.

* * * * *